United States Patent [19]

Hasegawa

[11] 4,355,611

[45] Oct. 26, 1982

[54] THROTTLE LINKAGE SYSTEM IN AN AUTOMOBILE PROVIDED WITH AN INTERNAL COMBUSTION ENGINE

[75] Inventor: Akira Hasegawa, Susono, Japan

[73] Assignee: Toyota Jidosha Kogyo Kabushiki Kaisha, Tokyo, Japan

[21] Appl. No.: 168,640

[22] Filed: Jul. 11, 1980

[30] Foreign Application Priority Data

Jul. 19, 1979 [JP] Japan ..... 54-90913

[51] Int. Cl.[3] ..... F02D 11/08

[52] U.S. Cl. ..... 123/396; 123/401

[58] Field of Search ..... 123/378, 389, 396, 401; 74/513; 192/109 D

[56] References Cited

U.S. PATENT DOCUMENTS

| | | | |
|---|---|---|---|
| 3,926,160 | 12/1975 | Husband | 123/396 |
| 4,026,255 | 5/1977 | Weiler, Jr. | 123/396 |
| 4,077,370 | 3/1978 | Spangenberg | 123/401 X |

*Primary Examiner*—William A. Cuchlinski, Jr.
*Attorney, Agent, or Firm*—Finnegan, Henderson, Farabow, Garrett & Dunner

[57] ABSTRACT

An apparatus for controlling movement of an accelerator pedal in an automobile provided with an internal combustion engine. The apparatus includes a damping cylinder connected to a linkage system. The damping cylinder has a piston made of a rubber material. A vacuum chamber is formed on one side of the piston, which chamber is connected to a vacuum source in the engine, so that the accelerator pedal is urged to move so that the throttle valve is returned to an idle position.

5 Claims, 4 Drawing Figures

THROTTLE LINKAGE SYSTEM IN AN AUTOMOBILE PROVIDED WITH AN INTERNAL COMBUSTION ENGINE

FIELD OF THE INVENTION

The present invention relates to a linkage system for connecting an accelerator pedal with a throttle valve in an automobile provided with an internal combustion engine.

BACKGROUND OF THE INVENTION

In an automobile provided with a carburetor type internal combustion engine, a throttle valve is connected to an accelerator pedal via a linkage system. Spring means are provided in the system for urging the throttle valve toward an idle or fully closed position. When the accelerator pedal is stepped on against a force of the spring means, a predetermined degree of the throttle opening is obtained, in accordance with the force applied to the accelerator pedal. In such a linkage system, a herein-after described jerking movement of the operator frequently takes place during rapid acceleration. When the accelerator pedal of a vehicle moving at a low speed is sharply depressed, fast acceleration of the vehicle occurs so that the operator is jerked backwardly toward the seat against the spring force of the seat. Therefore, the foot of the operator is apt to become detached from the accelerator pedal, so that the throttle valve is moved toward the idle position. Therefore, engine breaking takes place, causing the operator to experience a deceleration of the vehicle. Thus the operator is jerked forwardly away from the seat, so that the accelerator pedal is again stepped on by the foot of the operator. Therefore, a large acceleration is again generated. These steps are repeated so that the operator is jerked forward and backward, which prevents normal operation of the vehicle.

SUMMARY OF THE INVENTION

An object of the present invention is to provide an apparatus, capable of preventing the above-mentioned jerking movement of the operator.

Another object of the present invention is to provide a damping apparatus for effecting controlled movement of the accelerator pedal.

According to the present invention, an apparatus is provided for transmitting the movement of an accelerator pedal of an automobile to a throttle valve arranged in an intake system of an internal combustion engine of the automobile, said apparatus comprising:

linkage means connecting the accelerator pedal with the throttle valve for transmitting the movement of the accelerator pedal to a throttle valve for turning the throttle valve about an axis thereof;

spring means co-operating with the linkage means for urging the accelerator pedal to a released position wherein the throttle valve is in its idle position; and damper means co-operating with the linkage means for generating a frictional force, as well as a vacuum force, said vacuum force being adapted for urging the throttle valve so that the valve is moved to the idle position. The damper is adapted for maintaining controlled movement of the accelerator pedal. Therefore, controlled acceleration of the vehicle is always attained, preventing any occurence of a jerking movement of the operator which occurs in the prior art.

BRIEF DESCRIPTION OF THE ATTACHED DRAWINGS

FIG. 1 generally shows an embodiment of a throttle linkage system of the present invention.

FIG. 2 is a longitudinal sectional view of the damping cylinder in FIG. 1.

FIG. 3-*a* is a schematic view showing the shape of an inner bore of the cylinder in FIG. 2.

FIG. 3-*b* is a graph showing the relationships between a throttle opening and a frictional force generated between the cylinder and the piston.

FIG. 4 is a diagram showing the relationships between the throttle opening and a force applied to an accelerator pedal.

DESCRIPTION OF A PREFERRED EMBODIMENT

Figure 1:
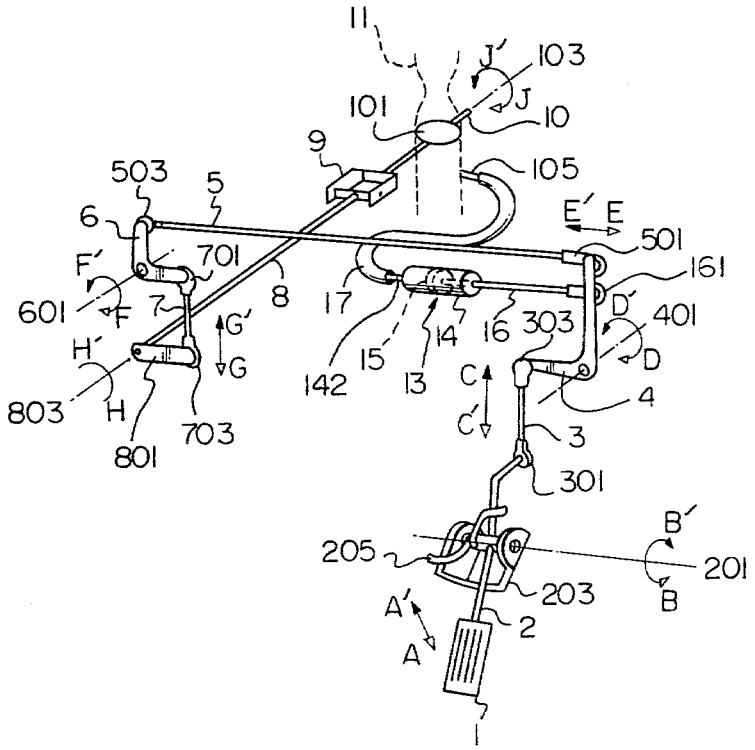

Referring to FIG. 1, which schematically illustrates a construction of the present invention, a reference numeral 1 designates an accelerator pedal of a motor vehicle. An accelerator lever 2 is, at an axis 201, rotatably mounted to a bracket 203 which is fixedly connected to the body of the vehicle (not shown). A spring 205 urges the lever 2 so that the lever 2 turns about the axis 201 as shown by an arrow B', i.e., an end of the lever 2 abuts the lower side of the accelerator pedal 1 for urging the pedal 1 to move as shown by an arrow A'. The other end of the lever 2 is connected to a lower end of a first connecting rod 3 via a ball joint 301. The upper end of the first connecting rod 3 is connected, via a ball joint 303, to an end of a first bell crank member 4, which is rotatable about an axis 401. The other end of the crank member 4 is connected to an end of a second connecting rod 5 via a point 501. The other end of the second connecting rod 5 is connected, via a joint 503, to an end of a second bell crank member 6, which is rotatable about an axis 601. The other end of the crank member 6 is connected to the upper end of a third connecting rod 7 by a joint 701. The lower end of the connecting rod 7 is connected, via a joint 703, to a crank portion 801 of a rod 8. The rod 8 which is turnable about an axis 803 is connected, via a coupling 9, to a throttle shaft 10. The throttle shaft 10 is provided with a throttle valve 101 which is arranged in an air horn 11 of a carburetor of an internal combustion engine. The throttle shaft 10 is rotatable about an axis 103 for turning the throttle valve 101 in the air horn 11.

The apparatus of the present invention is provided with a damping cylinder device 13. The damping cylinder device 13 is provided with a cylinder 14 and a piston 15 slidably arranged in the cylinder 14. A piston rod 16 is connected to the bell crank member 4 by means of a joint 161. One side of the piston 15 remote from the piston rod 16 is connected via a vacuum hose 17 to a vacuum port 105 formed in the carburetor, so that the port 105 is opened to the intake line of the engine at a position located downstream of the throttle valve 101.

Figure 2:
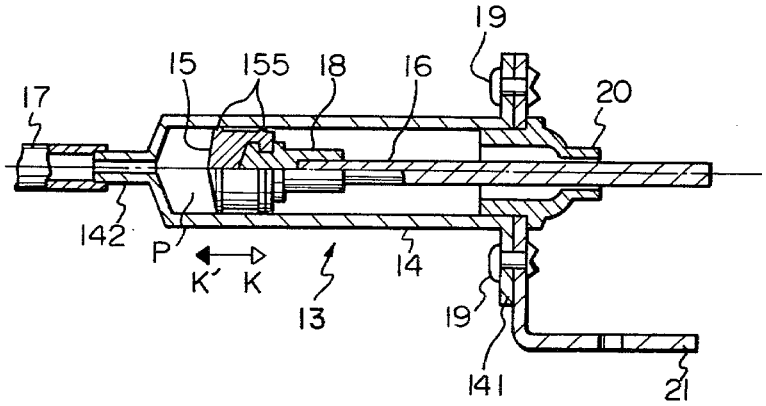

In FIG. 2, the piston 15 is made of a rubber material and is arranged in the cylinder 14 so that a frictional force is generated between the cylinder 14 and piston 15 when the piston 15 is moved with respect to the cylinder 14. Preferably, the piston 15 is provided with axially spaced apart annular lip portions 155 contacting with the inner surface of the cylinder 14. When the piston 15 is moved, the lip portions 155 are deformed so that a proper frictional force is generated, which is proportional to the degree of the deformation of the lip portions as well as to a spring coefficient of the lip portions in a circumferential direction. A piston holder 18 is on one end thereof fitted to the piston 15. To the other end of the holder 18, the piston rod 16 is fixedly inserted. The cylinder 14 is provided with a flange portion 141 which is fixedly connected to a bracket 21 fastened to the body of the vehicle by retainer means, such as rivets 19. The cylinder 14 is provided with a vacuum inlet 142 opened to a pressure chamber P formed on one side of the piston 15 remote from the piston rod 16. To the vacuum inlet 142, the vacuum hose 17 is inserted. A dust boot 20 is at one end thereof fitted to the cylinder 14 while the piston rod 16 freely passes through the other end, so that dust is prevented from being introduced into the cylinder.

Figure 3:
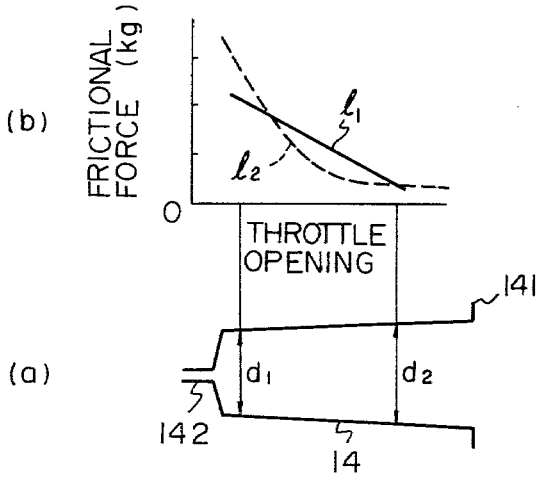

The cylinder 14 is tapered from the flange portion 141 toward the vacuum inlet portion 142. Therefore, as schematically shown in FIG. 3-*a*, the inner diameter $d_1$ of the cylinder 14 at a position adjacent to the vacuum inlet 142 is smaller than the inner diameter $d_2$ at a position adjacent to the flange portion 141.

It should be noted that a spring (not shown) is provided on the throttle shaft 10 for urging the throttle valve 101 so that it is moved to an idle or fully closed position.

Operation of the apparatus now will be described. When the accelerator pedal 1 is stepped on, as shown by the arrow A, the first connecting rod 3 is upwardly moved, as shown by an arrow C. The motion of the rod 3 is transmitted, via the first bell crank 4 turning as shown by an arrow D, to the second connecting rod 5 so that the rod 5 is moved toward the right, as shown by an arrow E. The second bell crank 6, turning as shown by an arrow F, causes the third connecting rod 7 to move downwardly, as shown by an arrow G. The motion is transmitted to the throttle shaft 10 via the arm 801, the rod 8 and the coupling 9, so that the throttle valve 101 is opened, as shown by an arrow J. When the accelerator pedal 1 is released by foot of the operator the accelerator pedal 1 is returned, as shown by the arrow A', due to the force of the spring 205. Therefore, a reverse motion is generated in every part constructing the linkage as shown by the arrows B', C', D', E', F', G' and H'. Therefore, the throttle valve 101 is turned in a direction as shown by an arrow J' toward the idle or fully closed position.

Figure 4:
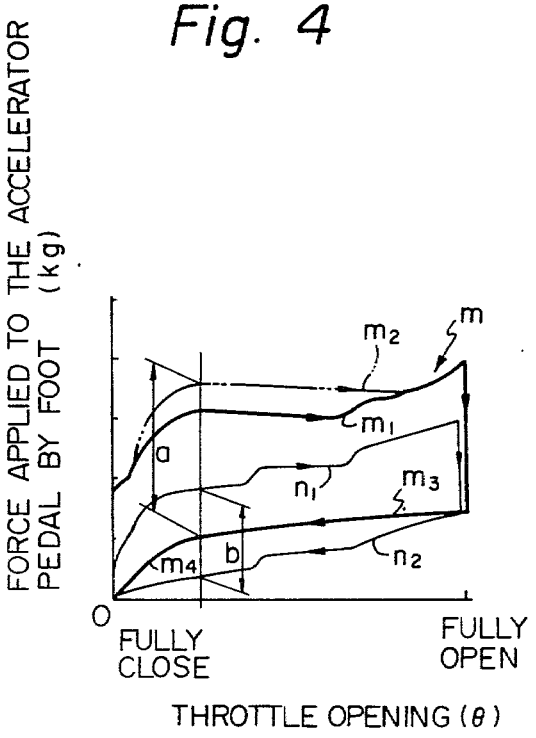

During the operation of the linkage apparatus, a damping force from the piston 15 is applied to the crank member 4 via the piston rod 16, which force is, on one hand, based on a frictional force generated between the piston 15 and the cylinder 14 and is, on the other hand, based on a vacuum force generated on the piston 15. This damping force serves to provide a characteristic damping curve forming a hysteresis loops m as shown in FIG. 4, which is the relationship between the degree of the throttle opening and the force applied to the accelerator pedal 1 by a foot of the operator. These characteristic curves will be more fully described.

The vacuum in the chamber P always urges the piston 15 to move so that the piston rod 16 is moved, as shown by an arrow K' (FIG. 2), i.e., the throttle valve 101 is turned about the axis 103, as shown by the arrow J' (FIG. 1), toward the idle or fully closed position. Therefore, when the accelerator pedal 1 is stepped on, as shown by the arrow A, in order to open or turn the throttle valve 101 about the axis 103, as shown by the arrow J, a damping force from the damping cylinder device 13 is applied to the bell-crank member 4 of the linkage apparatus, which force is a sum of the frictional force between the piston 15 and the cylinder and the vacuum force in the piston 15.

When the accelerator pedal 1 is moderately depressed, the vacuum force in the piston 15 is medium, so that the damping force, which is the sum of the vacuum force and the frictional force, is also medium. Therefore, a medium force which is necessary to move the accelerator pedal and is changed in accordance with the throttle opening, as shown by a curve $m_1$ in FIG. 4, is obtained.

When the accelerator pedal is rapidly depressed, a vacuum pressure at the chamber P has, until the throttle valve is fully opened, a large value corresponding to a high vacuum pressure in the intake pipe in the idle position of the throttle valve 101. Therefore, a large vacuum force is generated on the piston 15 together with the frictional force between the piston 15 and the cylinder 14. Therefore, a large force, which is necessary to move the accelerator pedal and is changed in accordance with the throttle opening, as shown by a curve $m_2$ in FIG. 4, is obtained.

As will be clear from the above, the present invention makes it possible to obtain a force applied to the accelerator pedal which increases as the increase in speed of movement (or depression) of the accelerator pedal 1. Therefore, controlled movement of the accelerator pedal is always maintained. Thus, any jerking motion which is inevitable in the prior art does not take place.

When the accelerator pedal 1 is released by a foot of the operator in order to return the throttle valve 101 to the idle position, a damping force is applied to the bell-crank member 4 of the linkage apparatus, which is the frictional force between the piston and the cylinder, substracted by the vacuum force in the piston 15.

Now it is assumed that the accelerator pedal 1 which partially opens the throttle opening, for example, ¼ of full throttle opening, is released by a foot of the operator. At the instant of the release of the foot from the accelerator pedal, the vacuum pressure at the chamber P is small, since the position of the throttle valve 101 is remote from the idle position. Therefore, the damping force, which is the frictional force subtracted by the vacuum force is large. (This force is shown in FIG. 4 by a curve $m_3$). Therefore, a rapid reduction of the speed of the vehicle does not take place even if the accelerator pedal is rapidly detached by the foot of the operator.

After a predetermined time has lapsed from the release of the accelerator pedal 1, the vacuum pressure at the chamber P becomes large, due to the small opening of the throttle valve 101. Therefore, the force applied to the pedal, which is the frictional force subtracted by the large vacuum force, is small. Therefore, the accelerator pedal 1 is rapidly returned to the idle position, as shown by the line $m_4$ in FIG. 4.

When a large deceleration is applied to the operator during a running of the vehicle, the accelerator pedal 1 does not accidentally move since a force which is necessary to move the accelerator pedal is large as shown by the curve $m_1$ or $m_2$.

It should be noted that in the prior art a relationship between the throttle opening and the force applied to the accelerator pedal 1 is shown by a curve $n_1$ when the pedal 1 is stepped on, and by a curve $n_2$ when the pedal 1 is released. Therefore, in the prior art, the amount of hysteresis is, at the throttle opening (¼ of full open), as small as b. In the present invention, the amount of hysteresis at the same throttle opening is as large as a.

In FIG. 3-*a*, since the cylinder has a tapered inner bore the frictional force between the piston and cylinder decreases in accordance with the increase of the throttle opening as shown by curves in FIG. 3-*b*. Therefore, the frictional force is small when the throttle opening is in a range between $\frac{1}{4} \sim \frac{1}{2}$ of the full opening. As a result of this construction, the frictional force at a large throttle opening becomes small, even if the vacuum force is small. Therefore, a positive return movement of the throttle valve 101 from the fully opened position is effected. As shown in FIG. 3-*b*, a straight relationship $l_1$ or a curved relationship $l_2$ can be obtained by selection of the tapered shape of the inner bore of the cylinder.

According to the present invention, a vacuum force is always applied to the linkage, so that the throttle valve 101 is urged to move toward the idle position. Therefore, if the return spring is damaged during the running of the vehicle, the throttle valve 101 can always be returned to the idle position. Therefore, if the return spring should become damaged, speed of the vehicle can be controlled, and a dangerous accident can be prevented from occuring.

It should be noted that if the hose 17 is accidentally withdrawn from the vacuum inlet 142 during the running of the engine, external air is introduced into the intake system of the engine. Therefore, operation of the engine cannot be continued.

It should be noted that the speed of the opening of the throttle valve is restricted due to the damper effect of the present invention. Thus controlled acceleration can always be effected so that the amount of toxic emission in the exhaust system is decreased.

While the present invention is described with reference to the attached drawings, many modifications and changes may be made by those skilled in this art without departing from the scope of the present invention.

I claim:

1. An apparatus for transmitting movement of the accelerator pedal of an automobile to the throttle valve arranged in an intake system of an internal combustion engine of the automobile, said apparatus comprising:

linkage means connecting the accelerator pedal with the throttle valve for transmitting movement of the accelerator pedal to the throttle valve, which movement turns the throttle valve;

spring means co-operating with the linkage means for urging the accelerator pedal to move toward a position wherein the throttle valve is in its idle position;

a damper comprising a cylinder and a piston member arranged in the cylinder, said piston member comprising a piston made of a rubber material and having at least one annular deformable lip portion slidably contacting the inner surface of the cylinder, a piston holder fitted on one end to the piston, and a piston rod connected to the other end of the piston holder, the piston rod being connected to the linkage means, a vacuum pressure chamber formed in said cylinder at the end of the piston opposite said piston holder and means for connecting said chamber to a vacuum source for urging said piston into a position for closing said throttle valve.

2. An apparatus according to claim 1, wherein said vacuum source comprises a vacuum port formed in the intake system at a position located downstream of the throttle valve.

3. An apparatus according to claim 1, wherein said cylinder has an inner bore tapered in such a manner that the diameter of the bore at a position of the piston wherein the throttle valve is open is larger than the diameter of the bore at a position of the piston wherein the throttle valve is closed.

4. An apparatus according to claim 1, wherein the piston has two axially spaced apart annular lip portions, one lip portion being thicker than the other.

5. An apparatus according to claim 1 or 4 wherein the movement of said piston is a function of the force of said vacuum force on said piston and the force of the friction between said piston and said cylinder wherein the frictional force is proportional to the degree of deformation of said lip portions by said cylinder and the spring coefficient of the lip portion or portions in the circumferential direction.

* * * * *